United States Patent [19]

Aitken

[11] 4,310,324

[45] Jan. 12, 1982

[54] METHOD AND APPARATUS FOR THE MANUFACTURE OF FUSECORD

[75] Inventor: Robert M. Aitken, Stevenston, Scotland

[73] Assignee: Imperial Chemical Industries Limited, London, England

[21] Appl. No.: 109,904

[22] Filed: Jan. 7, 1980

[30] Foreign Application Priority Data

Jan. 24, 1979 [GB] United Kingdom ..... 02492/79

[51] Int. Cl.[3] ..... F42C 19/02

[52] U.S. Cl. ..... 86/1 R; 102/275.1; 102/275.8; 493/302; 493/948

[58] Field of Search ..... 93/78, 77 FT, 77 CL, 93/80, 94 R, 77 R, 1 F; 53/548–550, 450; 102/27 R; 86/22, 1 R; 156/438; 493/297, 302, 948, 42, 46–49

[56] References Cited

U.S. PATENT DOCUMENTS

| | | | |
|---|---|---|---|
| 1,433,242 | 10/1922 | Shardlow | 57/16 |
| 3,621,558 | 11/1971 | Welsh et al. | 102/27 R X |
| 3,772,967 | 11/1973 | Burrus et al. | 93/1 C |

FOREIGN PATENT DOCUMENTS

| | | |
|---|---|---|
| 295266 | 8/1928 | United Kingdom . |
| 844442 | 8/1960 | United Kingdom . |
| 1150121 | 4/1969 | United Kingdom . |
| 1160318 | 8/1969 | United Kingdom . |
| 1221346 | 2/1971 | United Kingdom . |
| 1345233 | 1/1974 | United Kingdom . |
| 1365487 | 9/1974 | United Kingdom . |
| 1403721 | 8/1975 | United Kingdom . |

*Primary Examiner*—James F. Coan

*Attorney, Agent, or Firm*—Cushman, Darby & Cushman

[57] ABSTRACT

A method and apparatus is provided for the manufacture of dry spun explosive fusecord, the method comprising continuously advancing a carrier tape in a horizontal linear path, partially convoluting the tape to form a longitudinal open trough portion extending over a feed zone of said path, continuously feeding a stream of explosive material into the trough portion at a controlled rate appropriate to the formation of the desired explosive core, said stream being elongated and extending longitudinally over a portion of said feed zone, further convoluting the loaded tape to form a closed tube surrounding the explosive core and subsequently applying reinforcing materials around the closed tube. The carrier tape is preferably convoluted by carrying it through guides while the tape is supported on an auxiliary transport tape of stronger material. Helically spun layers of textile reinforcing material are advantageously applied from supply reels mounted in line co-axially with the path of the carrier tape, the fusecord passing through the center of each textile supply reel.

The method permits higher production rates and more uniform loading of the explosive core of the fusecord.

19 Claims, 7 Drawing Figures

METHOD AND APPARATUS FOR THE MANUFACTURE OF FUSECORD

This invention relates to a method and apparatus for the manufacture of dry spun explosive fusecord. The invention is useful for both incendiary and detonating fusecords.

In one widely used dry spinning process for fusecord manufacture a thin carrier tape of paper or synthetic plastics material is drawn in a vertically downward path through a guide tube wherein the tape is progressively convoluted into the form of a tube (herein termed the carrier tube) with the tape edges overlapping. Dry particulate explosive material, for example, pentaerythritol tetranitrate is continuously fed from a hopper through a nozzle or aperture into the end of the formed tube to form the explosive core of the fusecord, and the encased core is consolidated by passing the tube through compression dies and by helically winding (spinning) strands of wrapping material, for example, yarns or tapes, around the tube. An outer sheath of waterproof thermoplastics material is then extruded over the wrapping material. Although various modifications of this method have been proposed from time to time the method generally used is that described, for example, in U.K. patent specification No. 1,345,233. In this method the diameter of the aperture through which the explosive flows into the carrier tube cannot greatly exceed the the diameter of the carrier tube and this diameter restriction limits the rate of flow of explosive material into the tube and consequently restricts the production rate from any given fusecord manufacturing machine. Thus if the production rate is increased beyond a critical maximum by increasing the draw rate of the carrier tape, insufficient explosive powder will be fed into the carrier tube to form the desired explosive core. Moreover, the explosive material tends to 'bridge' in the narrow aperture giving rise to non uniform flow even at draw speeds lower than the critical maximum. In practice, therefore, the conventional dry spinning fusecord manufacturing apparatus is not capable of sustained production rates much above 20 meters per minute.

It is an object of this invention to provide a method and apparatus for the manufacture of explosive fusecord which will permit higher producton rates and more uniform loading of the explosive core than the method currently used.

In accordance with the present invention this object is achieved by continuously advancing a carrier tape in a horizontal linear path, partially convoluting said tape to form a longitudinal open trough portion extending over a feed zone of said path, continuously feeding a stream of explosive material into said trough portion at a controlled rate appropriate to the formation of the desired explosive core, said stream being elongated and extending longitudinally over a portion of said feed zone, further convoluting said tape in a zone subsequent to said feed zone to form a closed tube surrounding and conveying a core of explosive material and subsequently applying reinforcing materials around the said closed tube.

A method of fusecord manufacture wherein an excessive amount of explosive powder was fed into a channel-shaped portion of a horizontally advancing carrier tape, the excess was removed by scooping it over the tape edges, and the tape further convoluted to form a tube was proposed in U.K. patent specification No. 295,266. The method was not adapted to the high speed production of fusecord because the powder feed involved gravitational flow through an aperture not substantially greater than the core of the fusecord and, in any case, the spillage of excess explosive powder from fast moving tape would be unacceptable for safety reasons.

In the present invention the elongation of the stream of explosive material permits high flow rates into the narrow trough portion of tape and also ensures a gradual loading of the trough which gives uniform distribution and packing of the explosive material in the core.

The preferred method of feeding the explosive material comprises forming a substantially uniform layer of powdered explosive material, continuously advancing said layer to the feed zone at a controlled rate, for example, on a conveyor such as a belt or vibratory conveyor disposed at an angle to the carrier tape path, and permitting explosive material to fall continuously from the leading edge of said layer into the open trough-shaped tape portion. The explosive material feed rate may advantageously be controlled by monitoring the weight per unit length in the fusecord core and adjusting the relative speeds of advance of the explosive layer and the carrier tape in response to any variation from the weight nominally required for the desired explosive core. In practice it will be simpler to maintain a constant carrier tape speed and to adjust the speed of the explosive layer.

In an alternative feed rate control the weight of material on a portion of the conveyor is continuously monitored and controlled at the appropriate weight by adjustment of the supply of material to that portion of the conveyor.

The uniform layer may conveniently be formed on the conveyor surface by passing the material through gate means. In a convenient method the explosive material is fed from a hopper to the conveyor and the gate is located forward of the hopper, thereby forming a small reservoir of loose powder between the gate and the hopper which facilitates formation of the uniform layer.

In order to even out any irregularities in the explosive powder in the explosive core such as may arise due to the powder particles cohering and 'shearing' rather than flowing evenly from the conveyor, it is advantageous to rake or spread the powder in the core. For this purpose it is convenient to locate a spreader device in the powder path in the feed zone whereby the powder in the open trough portion of the carrier tape is slightly agitated and distributed more evenly in the powder core. A preferred spreader device comprises a length of thin multi-strand wire with an end portion teased out to form a brush. This wire may advantageously extend forward from the open trough portion into the closed tube.

The carrier tape is preferably convoluted by passing through shaping guides, for example, a trough-shaped guide for the partial convolution and a tubular guide for completion of the convolution into tube form. It is found that when the carrier tape is advanced through such guides at the higher speeds permitted by this invention the friction between the guide and the carrier tape can cause stretching or rupture of the tape with consequent damage of the explosive core. This damage may advantageously be avoided by assisting the passage of the carrier tape through the guides by pulling an auxiliary transport belt through the guides in frictional contact with the carrier tape. The auxiliary belt should preferably be made of stronger material than the carrier tape. An example of suitable belt material is woven textile fabric. This auxiliary belt is preferably an endless belt trained around a drive pulley, optionally around tensioning rolls and through the tape convoluting guides. It will be apparent that within the guides the auxiliary belt will conform to the surface shape of the carrier tape and, because of the frictional engagement with the carrier tape, much of the longitudinal strain on the carrier tape will be absorbed. The auxiliary belt must be driven at substantially the same speed as the carrier tape although in practice it is preferred to allow some slippage to ensure that the carrier tape is always maintained under tension to prevent bending and rupture of the filled tube.

In the present method of manufacture the reinforcing materials of explosive fusecord normally comprise helically wound layers of stranded material which are spun around the encased explosive core from supply reels mounted on one or more platforms and rotating orbitally around the fusecord path as described in U.K. patent specification No. 1,345,233. We have further found that at the production speeds made possible by the present invention the imbalance of supply reels on a platform rapidly rotating in a vertical plane causes excessive stress on the platform mounting. In order to avoid this we have found it advantageous to mount the supply reels in line coaxially with the path of the carrier tape, so that in operation the embryo fusecord passes through the centre of each reel. One or more strands from each reel is trained helically around the encased fusecord core by means of a driven rotatable guide, called a flyer, rotating around the encased fusecord core. With this arrangement the centrifugal forces are always balanced. Large reels can be used and stoppages for renewal or replenishment of the reels and the repair of broken strands are less frequent. A further advantage is that wrapping material in the form of tape can be readily spun on fusecord without twist whereas twist can only be avoided in the conventional method by employing special winding methods to fill the tape supply reels. In practice the strands from some reels will be spun in one direction and the remainder in the counter direction, the number and direction of the strands being chosen as required to give the desired strength, bending resistance and finish to the fusecord. Conveniently the reel is mounted freely on a hub so that it is rotated around its axis by the flyer pulling the strand of wrapping material from the reel.

The apparatus of the invention comprises draw means to advance a carrier tape in a horizontal linear path, guide means to convolute said carrier tape to form a longitudinal open trough portion at a feed zone, feed means to deliver a stream of explosive material to said trough portion at a controlled rate appropriate for the formation of the fusecord core, said feed means having an outlet whereby said stream is elongated in cross-section to extend over a longitudinal portion of said feed zone, further guide means to further convolute said carrier tape to form a closed tubular casing around the core of explosive material fed into said trough portion and means to apply reinforcing materials around said closed casing.

The feed means preferably comprises a conveying surface adapted to continuously advance powdered material in a direction at an angle to the carrier tape path, and gate means whereby a uniform layer of explosive powder may be continuously formed on said conveying surface, said conveying surface extending between said gate means and said feed zone wherein said uniform layer is in operation continuously discharged into the trough portion of said carrier tape. The conveying surface is advantageously provided by a conveyor belt. The feed means preferably comprises feed measuring means for continuously measuring the feed rate and means to adjust the conveyor speed in accordance with the measured feed rate to obtain a substantially uniform explosive loading.

The guide means advantageously comprises elongated guide elements providing internal guide surfaces defining at any given position the desired shaped of the carrier tape at that position. In preferred guide means an auxiliary transport belt adapted to conform to the shape of the guide surfaces and frictionally to engage the carrier tape is trained through the guide elements, drive means being provided to pull the auxiliary transport belt through the guides in the same direction and substantially at the same speed as the carrier tape.

The reinforcing material applicator means preferably comprises one or more reels of stranded wrapping material each reel having a tubular centre and being mounted for rotation around an axis coaxial with the path of the carrier tape and, in association with each reel, a rotatably driven flyer guide adapted to train one or more strands from its associated reel helically around the tubular casing surrounding the fusecord core as the encased core passes axially through the reel and to rotate said associated reel by the pull on the wrapping material. Conveniently the flyer is fixed to a driven hub on which the reel is freely rotatable, said hub having an axial bore through which in operation the embryo fusecord passes. Preferably a shaping die for the spun-wrapped fusecord core should be accommodated coaxially with the reel at the position where the wrapped core enters the reel.

The draw means preferably comprises one or more driven rollers adapted to engage the wrapped fusecord and advance it at a substantially uniform speed.

The invention is further illustrated by the preferred embodiment which is hereinafter described, by way of example, with reference to the accompanying drawings wherein FIG. 1 shows diagrammatically in plan fusecord being manufactured in apparatus in accordance with the invention;

In the drawings like parts are designated by the same numeral.

Figure 1:
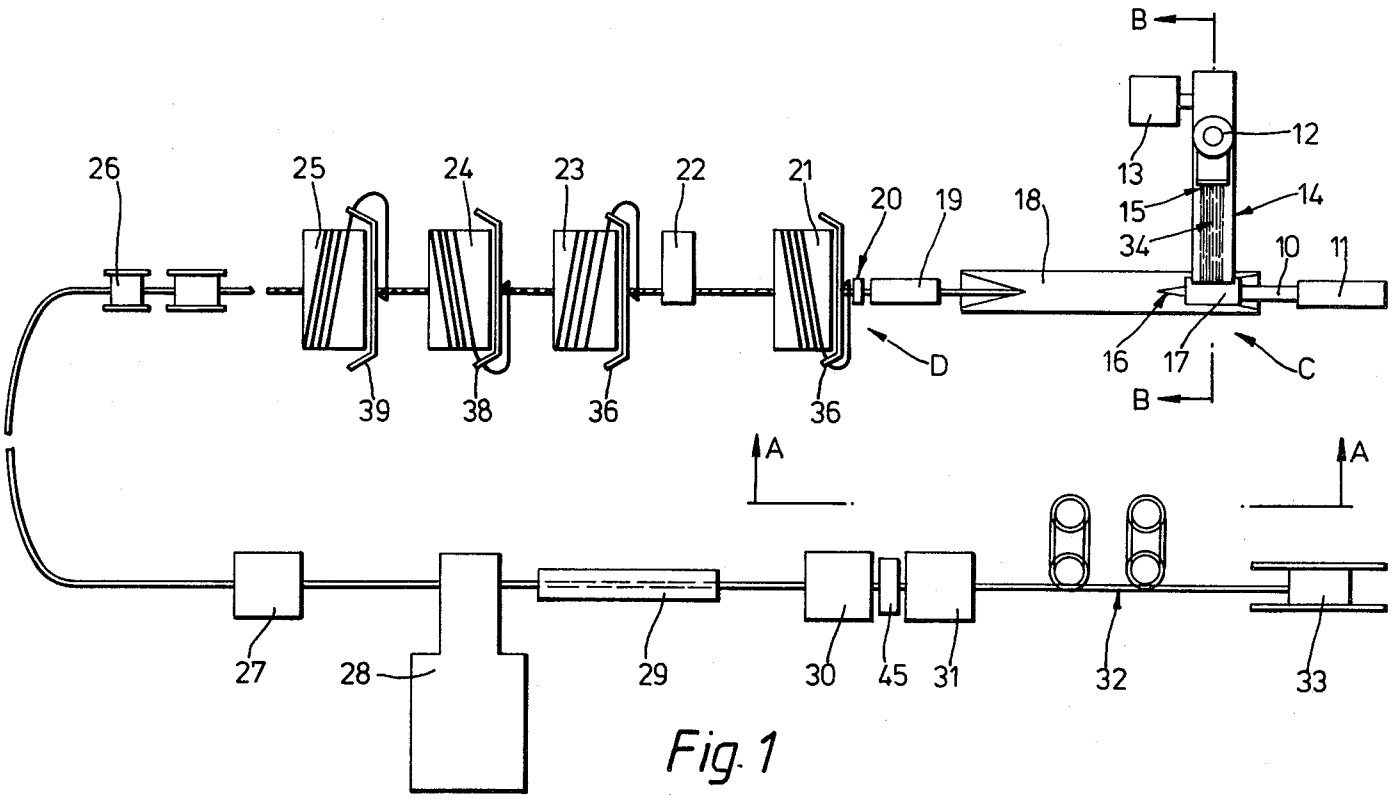
Figure 2:
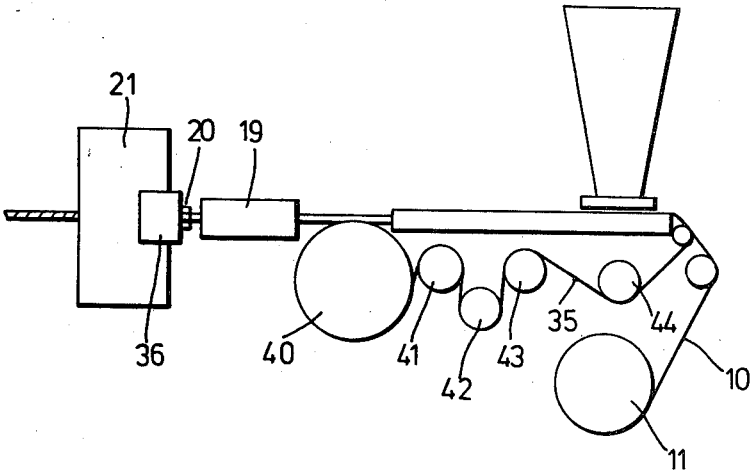
FIG. 2 shows diagrammatically in elevation a portion of the apparatus on the Line AA of FIG. 1.
Figure 3:
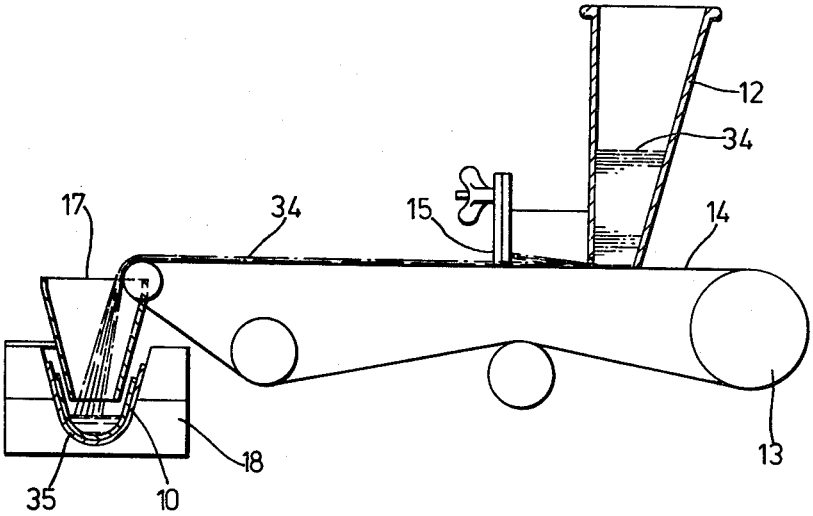
FIG. 3 shows diagrammatically in sectional elevation a portion of the apparatus on the Line BB of FIG. 1.
Figure 4:
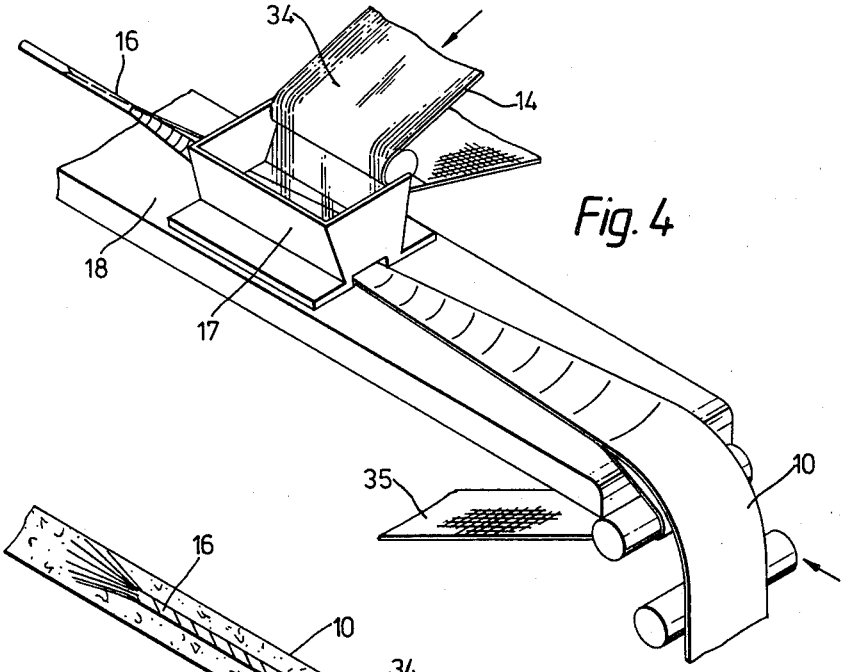
FIG. 4 is a fragmentary view in perspective in the direction of Arrow C in FIG. 1.
Figure 5:
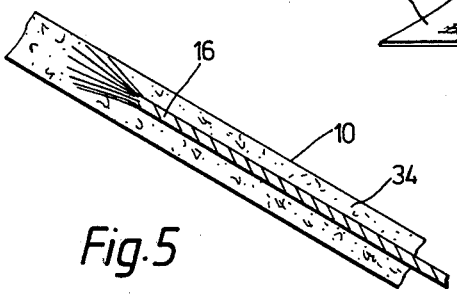
FIG. 5 is a fragmentary view in perspective of part of FIG. 4 on a larger scale.
Figure 6:
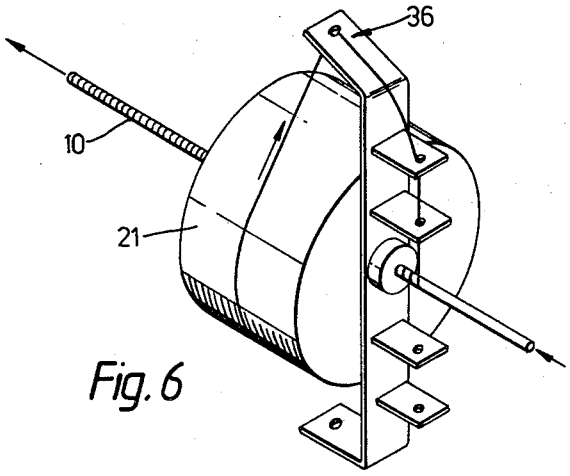
FIG. 6 is a fragmentary view in perspective of a flyer and reel assembly along the Arrow D in FIG. 1.

In the manufacture of explosive fusecord as shown in the drawings a carrier tape 10 is drawn by draw gear 26 from a reel 11 at a substantially constant speed through a tube-forming device 18 where the tape 10 is formed into an open trough of U-shaped cross-section. Explosive powder 34 is fed from a hopper 12 onto a conveyor belt 14 moving under the control of speed-control 13, whereon it is formed into a uniform layer by passing it through an adjustable gate 15 beside the outlet of the hopper 12. The explosive powder 34 is continuously discharged from the forward end of conveyor belt 14 into the trough portion of tape 10. The explosive powder drops freely from the forward edge of the conveyor belt 14 into the trough portion of tape 10 wherein the powder accumulates progressively over the length of tape below the end of the conveyor belt.

As the tape 10 is drawn further into the tube forming device 18 it is closed and overlapped into a tubular form containing a central core of explosive powder 32. A spreader 16 comprising a length of braided wire having a teased-out end portion is attached to the guide 17 and located in the powder stream in the open trough portion of the carrier tape forward of the end of the conveyor belt 14 and extending into the fully closed tube.

In its passage through the tube forming device 18 the tape 10 is supported on an auxiliary transport belt 35 of cotton or similarly strong material which is trained around drive roller 40, guide rolls 41, 42, 43 and 44 and through the tube forming device 16 wherein it conforms in shape to the tape 10. The belt 35 is driven at substantially the same rate as the tape 10 but the frictional contact between the tape 10 and belt 35 is such as to allow slight slippage, thereby enabling the tape 10 to be continuously under tension. With this arrangement any excessive stressing which might break the tape 10 is taken by the belt 35. At the end of the tube forming device 18 the tubular tape 10 leaves the transport belt 35 and is fed into a tube guide 19 wherein the now tubular tape 10 is maintained in its overlapped form and the powder 34 is consolidated. On emerging from the guide 19 the tubular tape 10 is drawn axially through a die 20 to shape the wrapped fuse core to the desired shape and diameter and then through the centres of reels 21, 23, 24 and 25 which are freely mounted on hollow driven hubs, each reel containing either one strand or several strands of wrapping material. The strands are removed from the reels by driven rotatable flyers 36, 37, 38 and 39 attached to the hubs and wrapped around the tubular tape 10 at a fixed rate to provide an even covering to the tubular tape 10. The wrapping material can be counter-spun as desired to give, for example, different finishes, strengths or bending characteristics to the fusecord. A measuring device 22, which is conveniently a Beta-ray monitor, is situated after the reel 21 to measure the cord density. Since the strands of wrapping material are substantially constant in density the measurements indicate the powder charge variation and any slight changes in the charge are rectified by adjusting the belt speed control 13 in response to the measured core density.

Figure 7:
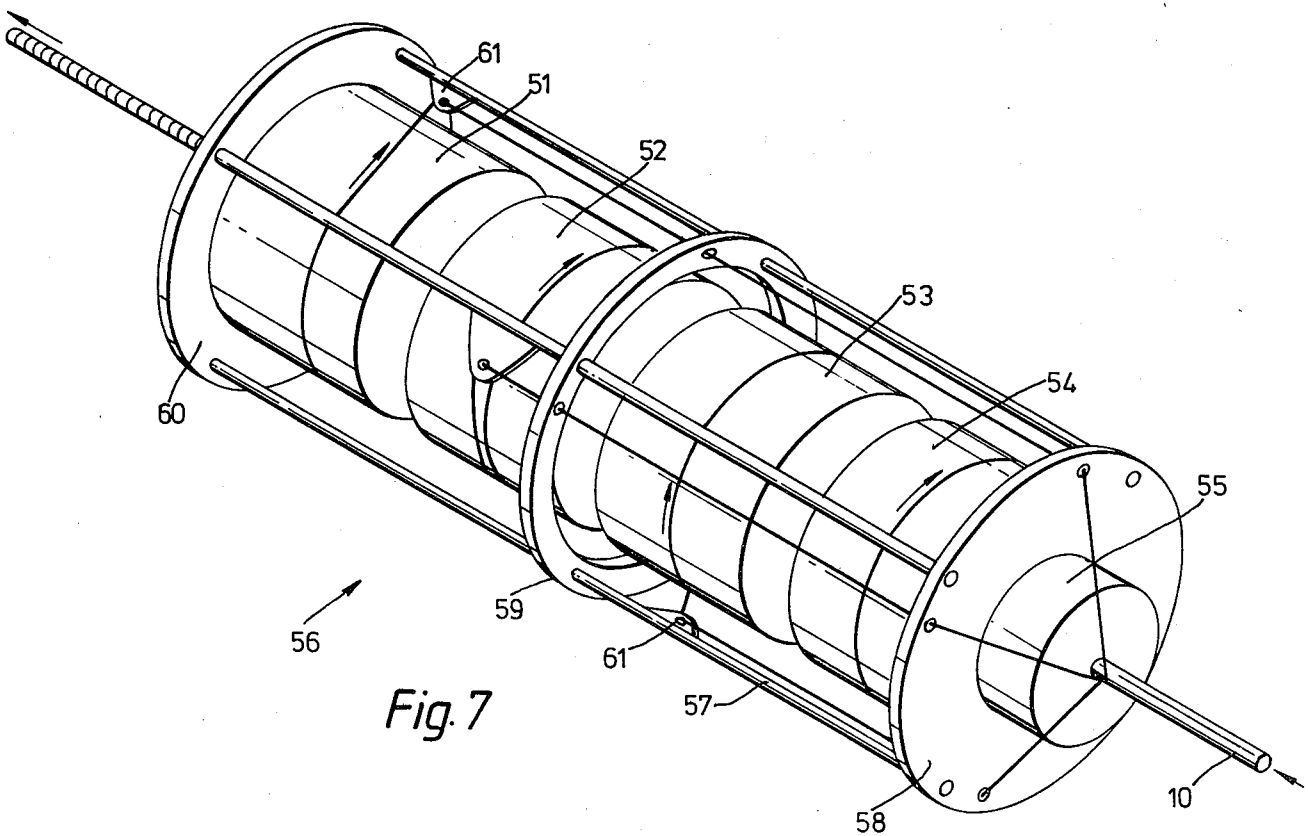
FIG. 7 shows in perspective a modified flyer and reel assembly alternative to that of FIG. 6.

In an alternative and more compact flyer and reel assembly shown in FIG. 7 a number of reels 51, 52, 53 and 54 are freely mounted for rotation on a hollow driven hub 55. The flyer assembly 56 attached to the hub shaft 55 comprises hollow outer guide bars 57 having eyelets 61 through which the strands of wrapping material are threaded. The guide bars 57 are supported on the hub shaft 55 by discs 58, 59 and 60.

Both flyer 56 and hub shaft 55 are driven and as the strands of wrapping material are helically wound around the tubular tape 10 the reels are pulled by the wrapping material and rotated in the same direction as the hub shaft 55 but at a slightly higher speed.

This alternative assembly becomes more advantageous as the number of reels is increased because it facilitates better control of the positioning of the strands of wrapping material on the fusecord.

The wrapped fusecord then passes the draw-gear 26 and subsequently it is drawn by draw-gear 31 through a detonation trap 27 and an extruder 28 wherein the cord is covered with a synthetic thermoplastics sheath. The draw speed of draw-gear 31 is matched to the speed of draw-gear 26 but small fluctuations in the relative speeds are accommodated by a tensioning device 45. The two draw-gears are used in order to reduce the degree of stretch which might be obtained over the length of thin fusecord being processed.

After the extruder 28 the cord is drawn by draw-gear 31 through a water bath 29 where it is cooled and through a further detonation trap 30. After passing the draw-gear 31 the cord is fed to a further accumulator 32 and then to a driven storage reel 33. Sufficient fusecord can be stored in the accumulator 32 to permit the reels 33 to be changed without stopping the production line. The reel 33 is driven through a slippage device to allow the rotational speed of the reel to alter as fusecord is progressively wound onto the reel without altering the main driving speed whilst allowing a fairly constant torque to be applied to the reel to enable the fusecord to be neatly laid on the reel. If desired the reel 33 may be a small reel on which fusecord is wound for dispatch, but in this case several reel driving heads and a change-over device would be necessary in order to give the operator time to remove the full reels and put on empty reels.

The accumulator 32 comprises sets of pulleys over which the yarn passes, the centres of the pulleys being adjustable in spacing so that a varying length of fuse can be contained between the pulleys.

Each of the draw-gears 26 and 31 comprises a capstan around which the cord is wrapped so that it is frictionally engaged by the capstan. The relative speeds of the draw-gears 26 and 31 are balanced by adjustment of draw-gear 31 by the tension device 45.

The rate of all the items of the production line can be varied individually but during a production run the relative rates of all items will remain fixed.

On completion of a run the supply reels of wrapping material and carrier tape become empty at approximately the same time. The following change procedure is then adopted.

The extruder 29, the powder feed, the flyer drive, the draw gears and the reel drive (to reel 33) are stopped. A new tape 10 is fitted and the old one removed. The large reels 21, 23, 24 and 25 are all replaced and a wire is put through all items. The new tape 10 and all new strands of wrapping material are tied in turn to the wire as it is pulled through the centre of all items until a full set of wrapping strands and carrier tape is pulled clear at the draw-gear 26. The embryo fusecord (semi-fuse) is now tied to the end of the cord just completed with a small knot to allow it to pass through the extruder die and the complete line run at low speed until the knot has passed through the extruder die. The powder is then re-started and the cord again run until properly filled cord reaches the extruder. The extruder is then restarted and the whole line run up to desired speed.

I claim:

1. A method for the production of explosive fusecord which comprises continuously advancing a carrier tape in a horizontal linear path partially convoluting said tape to form a longitudinal open trough portion extending over a feed zone of said path, continuously feeding a stream of powdered explosive material into said trough portion at a rate controlled to provide only the exact amount required for the formation of the desired explosive core, said stream being elongated and extending longitudinally over a portion of the feed zone of greater length than the diameter of the core to be formed and having uniform distribution of the powdered explosive material along the longitudinal extent of said portion, further convoluting said tape in a zone subsequent to said feed zone to form a closed tube surrounding the same amount of explosive material and conveying the thus-produced core of explosive material and subsequently applying reinforcing materials around the said closed tube.

2. A method as claimed in claim 1 wherein the method of feeding the explosive material comprises forming a substantially uniform layer of powdered explosive material on the surface of a conveyor continuously advancing said layer to the feed zone at a controlled rate and permitting explosive material to fall continuously from the leading edge of said layer into the open trough-shaped tape portion.

3. A method as claimed in claim 1 wherein the explosive powder in the open trough portion of the carrier tape is agitated to ensure its even distribution in the powder core.

4. A method as claimed in claim 1 wherein the carrier tape is convoluted by passing it through shaping guides comprising a trough-shaped guide for the partial convolution and a tubular guide for completion of the convolution of the tape into tube form, the passage of the carrier tape through the shaping guides being assisted by pulling an auxiliary transport belt through the guides in frictional contact with the carrier tape.

5. A method as claimed in claim 4 wherein the auxiliary belt is an endless belt trained around a drive pulley and through the tape convoluting guides.

6. A method as claimed in claim 1 wherein reinforcing stranded wrapping materials are spun around the closed carrier tube from one or more supply reels mounted co-axially with the path of the carrier tape, the closed carrier tube passing axially through the centre of each supply reel, one or more strands from each reel being trained helically around the closed carrier tube by means of a driven flyer rotating around the closed carrier tube.

7. A method as claimed in claim 6 wherein the supply reel of stranded material is mounted freely on a hub and is rotated around its axis by the flyer pulling the strand of wrapping material.

8. An apparatus for the manufacture of explosive fusecord comprising draw means to advance a carrier tape in horizontal linear path, guide means to convolute said carrier tape to form a longitudinal open trough portion at a feed zone, feed means to deliver a stream of explosive material to said trough portion at a rate controlled to provide only the exact amount required for the formation of the fusecord core, said feed means having an outlet whereby said stream is elongated in cross section to extend over a longitudinal portion of said feed zone of greater length than the diameter of the core of material to be formed by the apparatus and is uniformly distributed along said longitudinal portion, further guide means to further convolute said carrier tape to form a closed tube around the explosive material fed into said trough portion and means to apply reinforcing material around said closed tube.

9. An apparatus as claimed in claim 8 wherein the feed means comprises a conveying surface adapted to continuously advanced powdered material in a direction at an angle to the carrier tape path, and gate means whereby a uniform layer of explosive powder may be continuously formed on said conveying surface, said conveying surface extending between said gate means and said feed zone whereby said uniform layer is in operation continuously discharged into the trough portion of said carrier tape.

10. An apparatus as claimed in claim 9 wherein the conveying surface is provided by a conveyor belt.

11. An apparatus as claimed in claim 9 comprising feed measuring means for continuously measuring feed rate and means to adjust the conveyor speed in accordance with the measured feed rate to obtain substantially uniform explosive loading.

12. An apparatus as claimed in claim 8 comprising a spreader device located in the explosive powder path in the feed zone whereby the explosive powder is agitated and thinly distributed.

13. An apparatus as claimed in claim 12 wherein the spreader device comprises a length of multi-strand wire having its end portion teased out in the form of a brush.

14. An apparatus as claimed in claim 12 wherein the spreader device extends forward from the open trough portion into the closed carrier tube.

15. An apparatus as claimed in claim 8 comprising an auxiliary transport belt trained through the guide means and drive means to pull the auxiliary transport belt through the guide means in the same direction and substantially at the same speed as the carrier tape, said transport belt being adapted to conform to the shape of the guide surfaces and frictionally to engage the carrier tape.

16. An apparatus as claimed in claim 8 wherein the reinforcing material applicator means comprises one or more reels of stranded wrapping material each reel having a tubular center and being mounted for rotation around an axis coaxial with the path of the carrier tape and, in association with each reel, a rotatably driven flyer guide adapted to train one or more strands from its associated reel helically around the tubular casings surrounding the fusecord core as the encased core passes axially through the reel and to rotate said associated reel by the pull on the wrapping material.

17. An apparatus as claimed in claim 16 wherein the flyer is fixed to a driven hub on which the reel is freely rotatable, said hub having an axial bore through which in operation the encased fusecord core passes.

18. An apparatus for the manufacture of explosive fusecord comprising draw means to advance a carrier tape in horizontal linear path, guide means to convolute said carrier tape to form a longitudinal open trough portion at a feed zone, an auxiliary transport belt trained through the guide means and drive means to pull the auxiliary transport belt through the guide means in the same direction and substantially at the same speed as the carrier tape, said transport belt being adapted to conform to the shape of the guide surfaces and frictionally to engage the carrier tape, feed means to deliver a stream of explosive material to said trough portion at a rate controlled to provide only the exact amount required for the formation of the fusecord core, said feed means having an outlet whereby said stream is elongated in cross section to extend over a longitudinal portion of said feed zone of greater length than the diameter of the core of material to be formed by the apparatus and is uniformly distributed along said longitudinal portion, further guide means to further convolute said carrier tape to form a closed tube around the explosive material fed into said trough portion and means to apply reinforcing material around said closed tube, said means including at least one reel of stranded wrapping material, the reel having a tubular centre and being mounted for rotation around an axis coaxial with the path of the carrier tape and, in association with the reel, a rotatably driven flyer guide adapted to train at least one strand from the reel helically around the closed tube surrounding the fusecord core as the encased core passes axially through the reel and to rotate the reel by the pull on the wrapping material.

19. A method for the production of explosive fusecord which comprises continuously advancing a carrier tape in a horizontal linear path partially convoluting said tape to form a longitudinal open trough portion extending over a feed zone of said path, continuously feeding a stream of explosive material into said trough portion at a rate controlled to provide only the exact amount required for the formation of the desired explosive core, said stream being elongated and extending longitudinally over a portion of the feed zone of greater length than the diameter of the core to be formed and having uniform distribution of the powdered explosive material along the longitudinal extent of said portion, further convoluting said tape in a zone subsequent to said feed zone to form a closed tube surrounding and conveying the thus-produced core of explosive material, said partial and further convoluting steps being effected by passing the carrier tape through shaping guides comprising a trough-shaped guide for the partial convolution and a tubular guide for completion of the convolution of the tape into tube form, the passage of the carrier tape through the shaping guides being assisted by pulling an auxiliary transport belt through the guides in frictional contact with the carrier tape, and subsequently applying reinforcing stranded wrapping materials to said closed tube by spinning the materials around said closed tube from at least one supply reel mounted co-axially with the path of the carrier tape, said closed tube passing axially through the centre of the supply reel, at least one strand from the reel being trained helically around said closed tube by means of a driven flyer rotating around said closed tube.

* * * * *